US008397959B2

(12) United States Patent
Helmenstein

(10) Patent No.: US 8,397,959 B2
(45) Date of Patent: Mar. 19, 2013

(54) PACKAGING CONTAINER

(75) Inventor: Achim Helmenstein, Engelskirchen (DE)

(73) Assignee: Fischbach KG Kunststoff-Technik, Engelskirchen (DE)

( * ) Notice: Subject to any disclaimer, the term of this patent is extended or adjusted under 35 U.S.C. 154(b) by 1145 days.

(21) Appl. No.: 12/289,803

(22) Filed: Nov. 5, 2008

(65) Prior Publication Data

US 2009/0114684 A1 May 7, 2009

(30) Foreign Application Priority Data

Nov. 6, 2007 (DE) ..... 10 2007 053 205
Feb. 2, 2008 (DE) ..... 10 2008 007 305

(51) Int. Cl.
*B67D 3/00* (2006.01)

(52) U.S. Cl. ..... 222/538; 215/220; 215/255; 215/278; 215/305; 215/306; 220/269; 220/270; 220/375; 222/153.07; 222/327; 222/391; 222/541.8; 222/567; 222/529; 222/530

(58) Field of Classification Search ..... 222/153.07, 222/327, 391, 526–538, 541.9, 541.5, 541.7–541.8, 222/566–567, 570, 573, 543; 215/45, 220, 215/255–256, 258, 278, 303–306; 220/249, 220/269–270, 359.2, 375
See application file for complete search history.

(56) References Cited

U.S. PATENT DOCUMENTS 2,760,683 A * 8/1956 Diether ..... 222/143
3,278,089 A * 10/1966 Heekin et al. ..... 222/153.07
3,282,476 A * 11/1966 Tracy ..... 222/484
3,606,106 A * 9/1971 Yuhas ..... 222/153.07
3,667,638 A * 6/1972 Cambio, Jr. ..... 215/47
4,139,129 A * 2/1979 Chlystun ..... 222/529
4,463,867 A * 8/1984 Nagel ..... 220/270
4,595,123 A * 6/1986 Libit ..... 222/23
4,899,909 A 2/1990 Summons et al.
4,956,103 A * 9/1990 Jessop et al. ..... 210/787
5,090,583 A * 2/1992 Hoffman et al. ..... 215/253
5,104,013 A * 4/1992 Hawley ..... 222/566
5,133,470 A * 7/1992 Abrams et al. ..... 215/250
5,297,697 A * 3/1994 Boring ..... 222/83
5,348,184 A * 9/1994 Adams et al. ..... 220/266
5,397,013 A * 3/1995 Adams et al. ..... 220/255.1
5,775,551 A * 7/1998 Tordsen ..... 222/567
5,799,840 A * 9/1998 Mogard ..... 222/541.5
5,908,124 A * 6/1999 Klauke et al. ..... 215/48
6,056,142 A * 5/2000 Elliott ..... 220/278

(Continued)

FOREIGN PATENT DOCUMENTS

DE 2 057 612 5/1972
DE 34 06 323 A1 3/1985

(Continued)

*Primary Examiner* — Paul R Durand
*Assistant Examiner* — Andrew P Bainbridge
(74) *Attorney, Agent, or Firm* — Miles & Stockbridge P.C.; David R. Schaffer, Esq.

(57) ABSTRACT

A packaging container formed by a container body has a connector with a thread. The connector has a predetermined breaking point where a tear-off part may be torn off. The tear-off part has a handle and may be torn off without a tool. The container body is fitted with an application nozzle which, when not in use, is positioned on the handle.

24 Claims, 7 Drawing Sheets

U.S. PATENT DOCUMENTS

| | | | | |
|---|---|---|---|---|
| 6,474,508 | B1 * | 11/2002 | Marsh | 222/83 |
| 6,484,904 | B1 | 11/2002 | Horner et al. | |
| 7,591,398 | B2 * | 9/2009 | Pritikin et al. | 222/80 |
| 2005/0057637 | A1 | 3/2005 | Brugner | |

FOREIGN PATENT DOCUMENTS

| | | | |
|---|---|---|---|
| DE | 295 05 788.2 | | 7/1995 |
| DE | 198 09 255 | A1 | 9/1999 |
| DE | 229 18 094 | U1 | 2/2001 |
| DE | 203 09 931 | U1 | 11/2004 |
| EP | 0878408 | A1 * | 4/1997 |
| EP | 0 878 408 | A1 | 11/1998 |
| WO | WO 99/44897 | | 9/1999 |
| WO | WO 2004/026707 | A1 | 4/2004 |
| WO | WO 2008/034733 | A1 | 3/2008 |

* cited by examiner

PACKAGING CONTAINER

BACKGROUND OF THE INVENTION

1. Field of the Invention

The invention refers to a packaging container of plastic material, comprising a container body, the front end of the body being provided with an end wall bearing a connector, while the rear end of the body is open prior to filling.

2. Description of Related Art

Such packaging containers serve to hold sealants, joint compounds, adhesives or the like. They include a piston bottom cooperating with the cartridge body, which bottom may be pushed forward using an extrusion tool so as to extrude the mass from the connector. In the packaging container, the mass is sealed hermetically from the environment. To open the container, a part of the connector is cut off so that an opening in the connector is exposed. The application of a cutting tool is troublesome and entails a risk of an injury during use. It requires taking the cutting tool, positioning the same at the correct position of the connector and, eventually, cutting the connector. The cut-off part is loose and will most often fall to the ground.

A packaging container with a handle at the connector is described in PCT/EP2007/059478 (not published prior to the priority date of the present application). In this packaging container the tear-off part can be torn manually from the connector without requiring a tool.

SUMMARY OF THE INVENTION

It is an object of the invention to provide a packaging container that allows for a more convenient handling by a user.

The packaging container of the present invention is defined by claim 1. It has a predetermined breaking point at the connector, wherein a tear-off part with a handle can be torn from the predetermined breaking point. Further, an application nozzle fastened at the container body is provided for connection with the connector. Preferably, this application nozzle is also ready for use without requiring a cutting tool. It is one object to provide an application system wherein the user needs no tool, be it to open the packaging container or to use the application nozzle.

In a preferred embodiment, the application nozzle has a flexible tab fastened to the connector. Further, after the tear-off part has been removed, the application nozzle may be set on the connector, while bending the tab, and connected therewith. On the one hand, the application nozzle is thus captively connected with the packaging container already in the shipping state. On the other hand, it only has to be set on the opened connector, while bending the tab, and be connected with the same. As long as the handle with the tear-off part is still on the connector, the application nozzle can not be fastened to the connector. Such a fastening can be done only after removal of the tear-off part. As it were, the tab forms a hinge for setting the application nozzle on the connector. The tab of the application nozzle may be supported rotatably at the connector so that the application nozzle can be screwed onto the connector after the tear-off part has been removed.

Suitably, the tab has a ring sitting in a circumferential groove of the connector. Thus, the tab is captively held at the connector. When the tear-off part is torn off, the groove will not be damaged. At the top and the bottom, the groove is delimited by a flank so that the ring of the taps is caught therein.

In a preferred embodiment of the invention, the tab has a window allowing the handle to pass therethrough when attaching the tab to the container. Thus, the tab is secured both against twisting relative to the connector and against premature upward bending. For this purpose, the handle extends to near the end wall and the outer circumference of the cartridge body. Since the handle is attached to the connector, the application nozzle is held in a defined position with respect to the handle while in the storage state. This ensures a uniform orientation of the application nozzles of all packaging containers. As an advantage thereof, each nozzle is always attached at an exactly defined position with respect to the cartridge, whereby the cartridge can also be packaged automatically in a shipping box with an exact positional orientation and whereby all cartridges can then be set up uniformly in a shelf in a Do-It-Yourself store.

In another preferred embodiment of the invention, the handle is arranged horizontally, substantially spaced from the end wall of the container body and is connected with the tear-off part of the connector. The tab of the application nozzle is connected with the connector either above or below the handle. Should it be connected blow the handle, the tear-off part may be removed first and the application nozzle is then bent onto the connector. If the connection is above the handle, the tab of the application nozzle must be removed first to then remove the tear-off part.

Suitably, the handle is of ergonomic design and therefore has a locally varying thickness. It is possible to connect the handle with the tear-off part on one side, but also to connect it in a wing-like manner on at least two sides of the tear-off part so as to allow the tear-off part to be twisted off.

A layer impairing permeation may be provided at the predetermined breaking point. Thus, it is achieved that an enhanced barrier effect of the package also exists in the region of the predetermined breaking point and that the packaged material is protected against external influences. The permeation-impairing layer which may be a metal or a plastic film, for example, may also form the predetermined breaking point.

Preferably, the application nozzle has a dispensing opening with a closure removable without a tool. This closure may be formed by a tear-off part with a gripping member for breaking off the tear-off part, or by a cap set on the nozzle. The application nozzle may also have a plurality of differently sized nozzle openings that can be broken off manually, so that a nozzle opening of a desired size and/or shape can be selected.

The closure may also be formed by a cap set on the nozzle, which cap is removable or may be replaced with another nozzle part included.

According to a particular embodiment of the invention, a guard means is provided to protect the predetermined breaking point of the connector against external influences. This guard means prevents a premature damaging of the predetermined breaking point and thus prevents a premature opening of the connector. The guard means may be designed such that it can be removed only after the handle has been removed from the connector. On the other hand, the guard means may also be designed such that it covers a part or all of the handle. Opening the connector would then require the removal of the guard means and to afterwards remove the tear-off part of the connector. These are two operations that have to be performed purposefully so that an inadvertent opening of the closure is largely excluded.

The guard means may be fork-shaped and have two resilient fork prongs. The fork prongs resiliently embrace the connector. They form both the guard means and a holder for the application nozzle.

The handle may be designed as a ring oriented coaxial with the container body and is connected with the tear-off part through a web. As an alternative, the handle may also be a flat or contoured disc formed in the manner of a plate and is connected with the tear-off part at its center. Another possibility is to provide the handle with two handle arms projecting in opposite directions or to configure it in the manner of a spoke wheel. In this variant, the tear-off part is removed from the connector by twisting the projecting handle arms together with the tear-off part relative to the rest of the container body, whereby the tear-off part is separated from the connector.

BRIEF DESCRIPTION OF THE DRAWINGS

The following is a detailed description of embodiments of the present invention with reference to the accompanying drawings.

In the Figures.

DETAILED DESCRIPTION OF THE PREFERRED EMBODIMENTS

Figure 1:
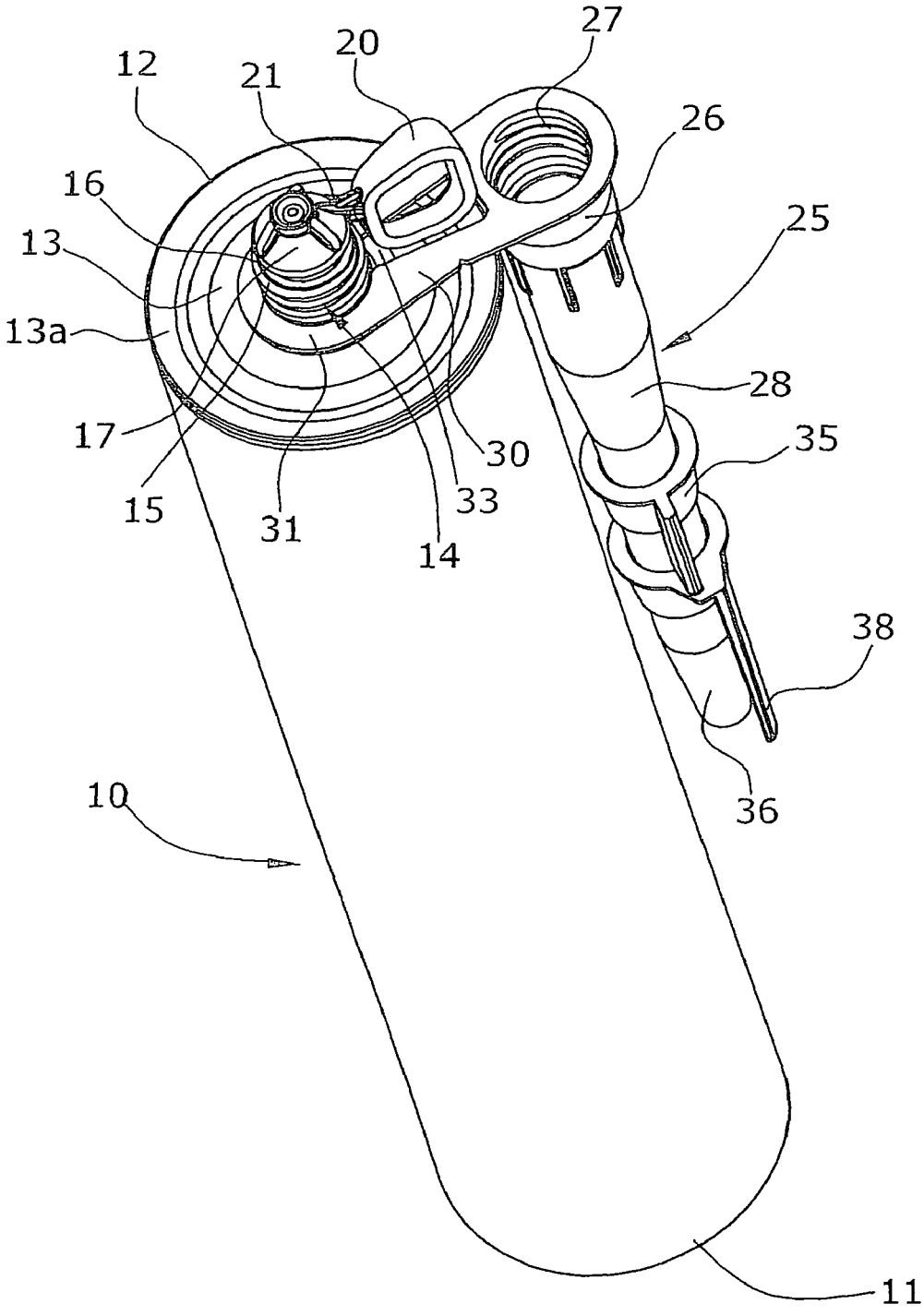
FIG. 1 is a perspective view of a packaging container of the present invention.

The packaging container consists of a rigid cartridge formed by an elongate cylindrical container body 10 of plastic material. The container body 10 is open at the rear end 11 and has an end wall 13 at the front end 12. A connector 14 with a thread 15 projects forward from the center of the end wall 13. The connector 14 has an annular predetermined breaking point 16 and a tear-off part 17 in the form of a cap. A permeation-impairing layer 18 is arranged in the cap which extends along the inner side of the connector and covers the predetermined breaking point 16 on the inside. The layer 18 is formed from a metal film, for example, or another material providing a good barrier effect against vapors and gases, whereby the predetermined breaking point 16, which has a reduced wall thickness, is sealed.

The tear-off part 17 is connected integrally with a handle 20. The handle 20 is of a generally annular shape, so that it can be engaged by a finger. The handle 20 includes a lug 21 connected with the tear-off part 17. The handle 20 is located in a radial plane E with respect to the longitudinal axis of the packaging container. It extends to near the end wall 13 and then dips into a trough 13*a* in the end wall. The handle 20 allows to manually tear the tear-off part 17 from the connector 14 without requiring a tool. The tear-off part 17 with the handle 20 will then be removed.

The packaging container comes with an application nozzle 25 captively connected with the packaging container. The application nozzle 25 is a tubular part having one end provided with a threaded sleeve 26 with an internal thread 27 which may be threaded on the external thread 15 of the connector 14. The application nozzle has an elongate frustoconical front part 28 terminating in an open tip 29. A tab 30 is formed to the rear end of the sleeve 26. The tab is formed by a flexible wide strip projecting radially from the longitudinal axis of the application nozzle 25. At a distance from the application nozzle 25, the tab 30 forms a ring 31 sitting in a circumferential groove 32 at the base of the connector 14. The ring 31 snaps into the groove 32 so that the tab can be removed from the connector only by force.

Further, the tab 30 is formed with a slot-shaped window 33 in the form of an opening through the material. This window 33 serves to receive the lower part of the handle 20. Thus, the tab 30 is fixed against rotation and is given the same radial orientation as the handle 20. In this manner, a defined orientation of the application nozzle 25 is achieved with respect to the handle 20. This is advantageous when a plurality of packaging containers is stored in a box, where the defined orientation of the application nozzles is a space-saving feature, and it is also advantageous in displaying the packaging containers in store shelves where all packaging containers show an orderly uniform appearance. When mounting or packaging the application nozzle 25 to the connector 14, the window serves as a passage opening for flapping the tab 30 over parts of the handle.

After the tear-off part 17 with the handle 20 has been torn off, the application nozzle 25 may be pivoted through approximately 180° by flexibly bending the tab 30 so that the tip 29 points forward and the thread 27 is positioned in front of the connector 14. By rotating the application nozzle, the threads 15 and 27 are engaged and the application nozzle is screwed to the container body 10. Here, the ring 31 rotates in the groove 32. It is an essential aspect that the application nozzle 25 is attached permanently to the container body and does not have to be detached from the container body to be screwed thereon. Prior to use, it is secured against twisting and/or pivoting.

Figure 2:
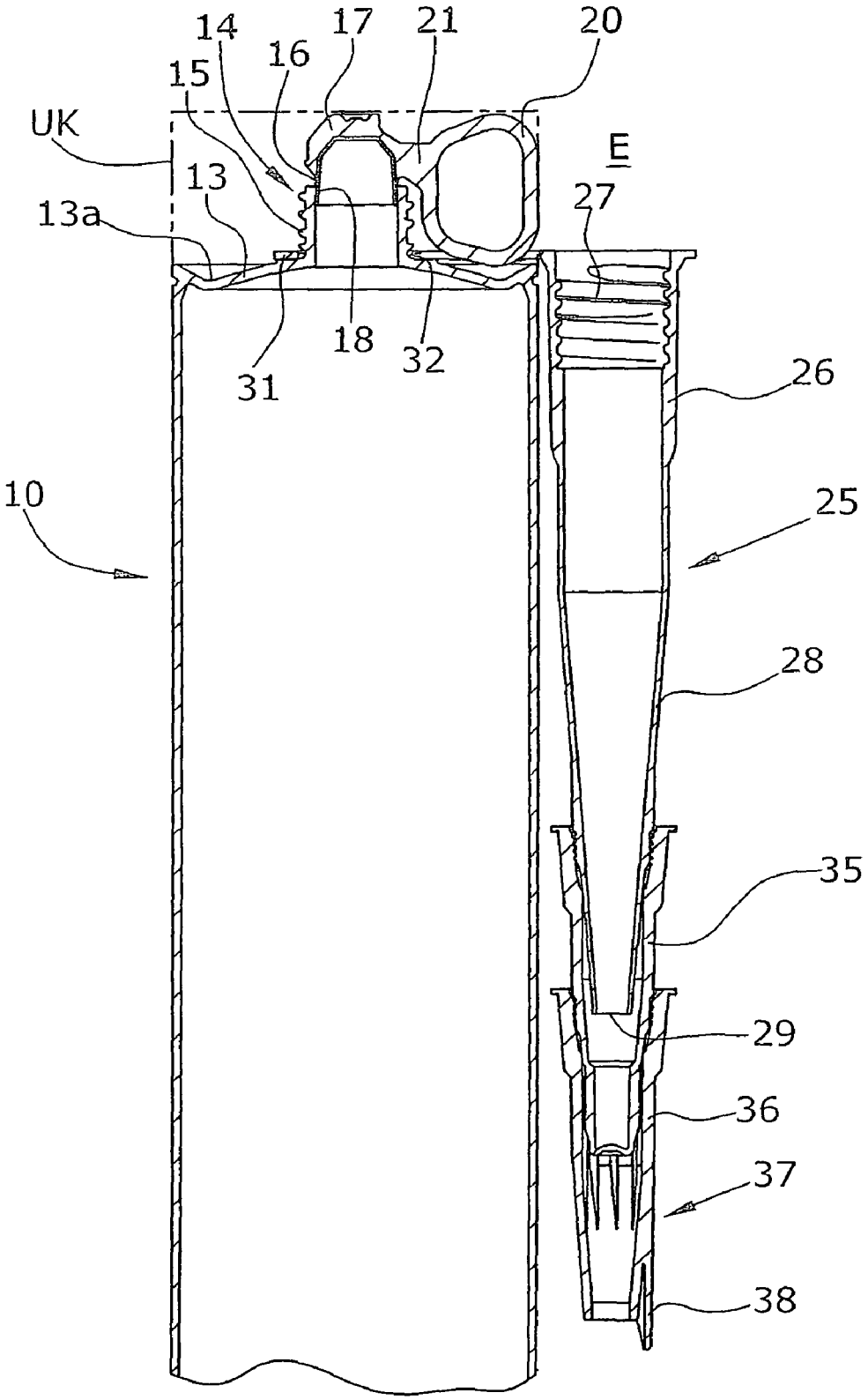
FIG. 2 is a longitudinal section (in the radial plane E) through the packaging container.
Figure 3:
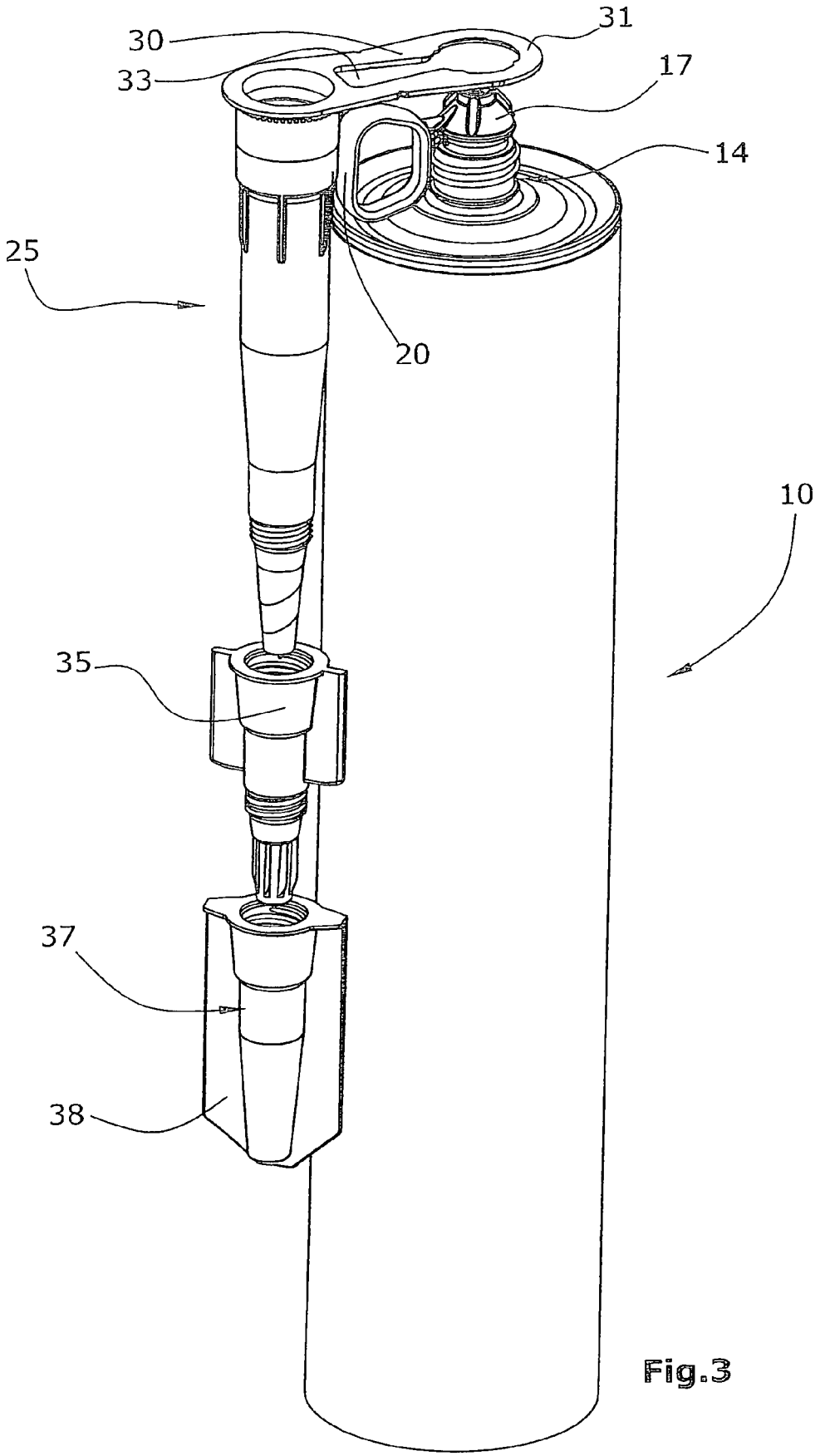
FIG. 3 is an exploded view of the packaging container.

As illustrated in FIG. 2, the handle 20 is arranged within the peripheral contour UK of the container body 10. This means that it does not project laterally beyond the contour. The upper end of the handle 20 does not protrude beyond the tear-off part 17. Thus, clearly defined limits exist in all directions.

The application nozzle 25 also has a closure that can be opened manually and without any tool. In this case, the closure is formed by a cap 35 closing the opening of the tip 29, the cap being impermeable. After use of the application nozzle, the cap 35 may be set on the nozzle and prevents a hardening of the product contained in the application nozzle.

In addition, the present embodiment is provided with a nozzle member 36 open at both ends, which may optionally be set on the cap 35 or on the application nozzle and forms a filling spattle 37. The filling spattle 37 is also formed by a tubular part with flexible wings 38 fixed thereto, which allow to immediately smoothen an outflowing mass.

Figure 4:
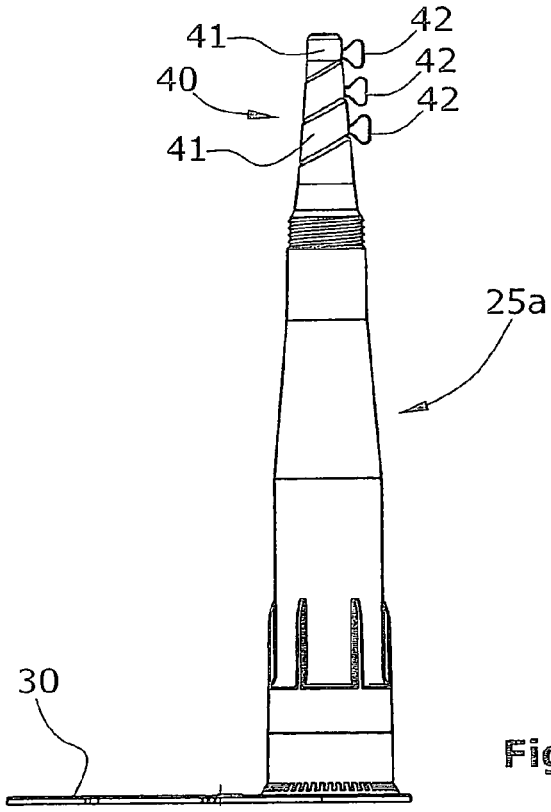
FIG. 4 is a side elevational view of an application nozzle.

FIG. 4 illustrates another embodiment of an application nozzle 25*a* with a tab 30 formed thereto, wherein the front end of the application nozzle is formed with a closure 40 made of successive rings 41 that can be broken off individually. Each ring 41 is provided with a gripping member 42 acting as a handle. The front end of the application nozzle 25*a* is closed. By purposefully tearing or breaking off the rings 41, the size of the nozzle opening to be formed can be determined.

Figure 5:
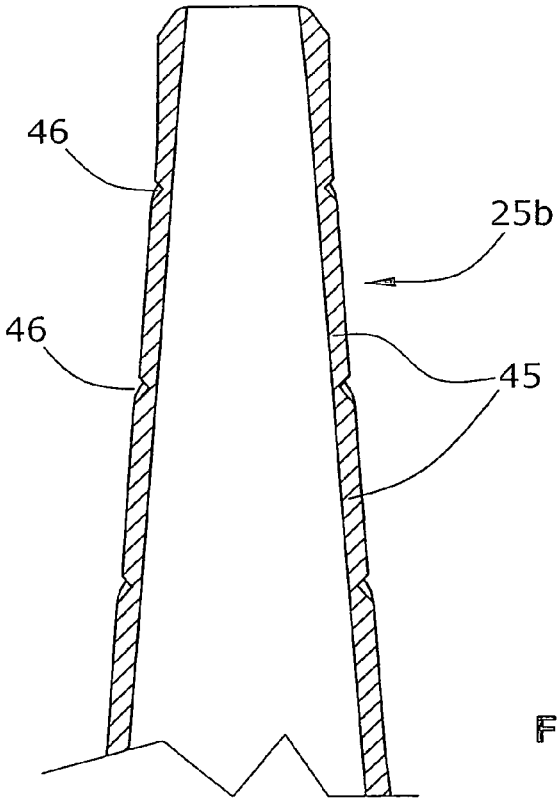
FIG. 5 is a longitudinal section through another application nozzle.
Figure 6:
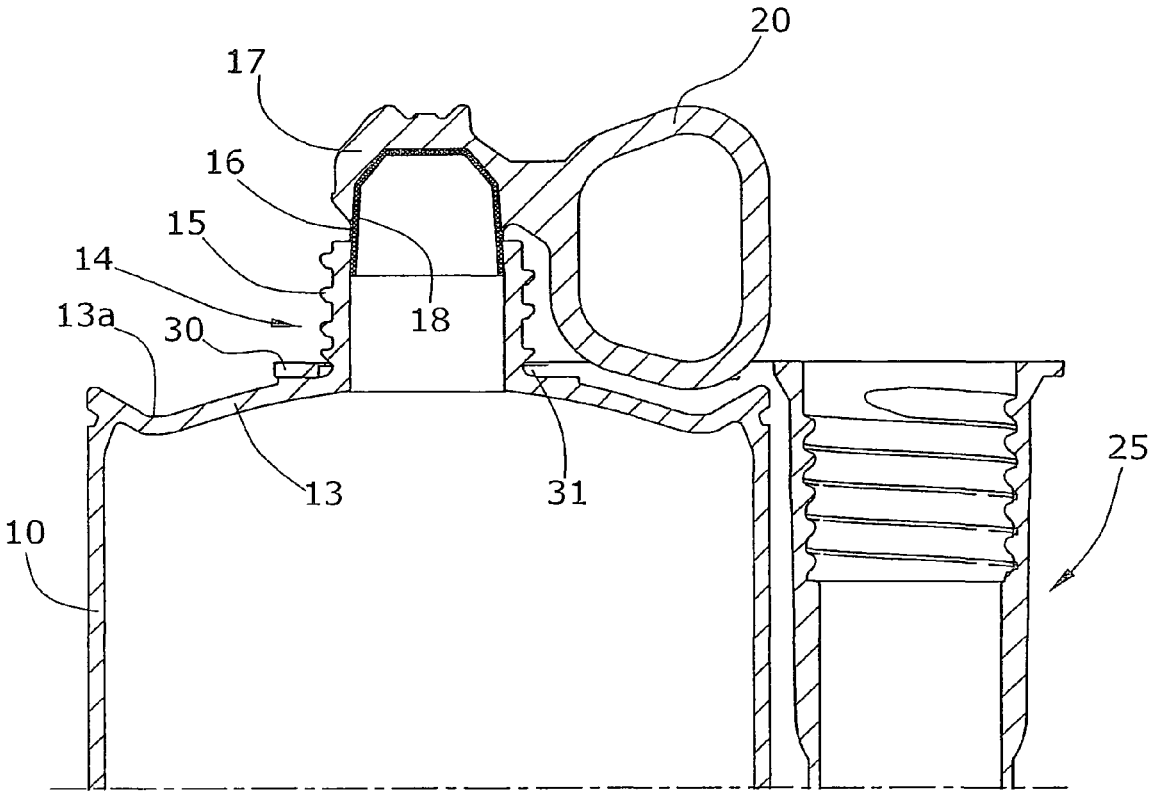
FIG. 6 is a longitudinal section through the front part of the packaging container with connector and handle.

FIG. 5 illustrates an embodiment of an application nozzle 25*b* with a plurality of ring members 45 separated by annular predetermined breaking points 46. The individual rings are manually severable, for example by breaking. This application nozzle may come with a cap 35 for closing.

The packaging container may be provided with protective cap or sleeve set on the connector 14 for the protection of the predetermined breaking point or the handle. This protective cap may also be part of the tab 30 of the application nozzle 25.

The container body may also be formed by a flexible sleeve that deforms in a bellows-like manner when compressed in an extrusion tool. The flexible sleeve may be formed from a single- or multi-layered composite film in order to achieve the desired barrier properties. In addition, the piston bottom and the end wall of the container body may be formed to the flexible container wall and may be rigid.

Figure 7:
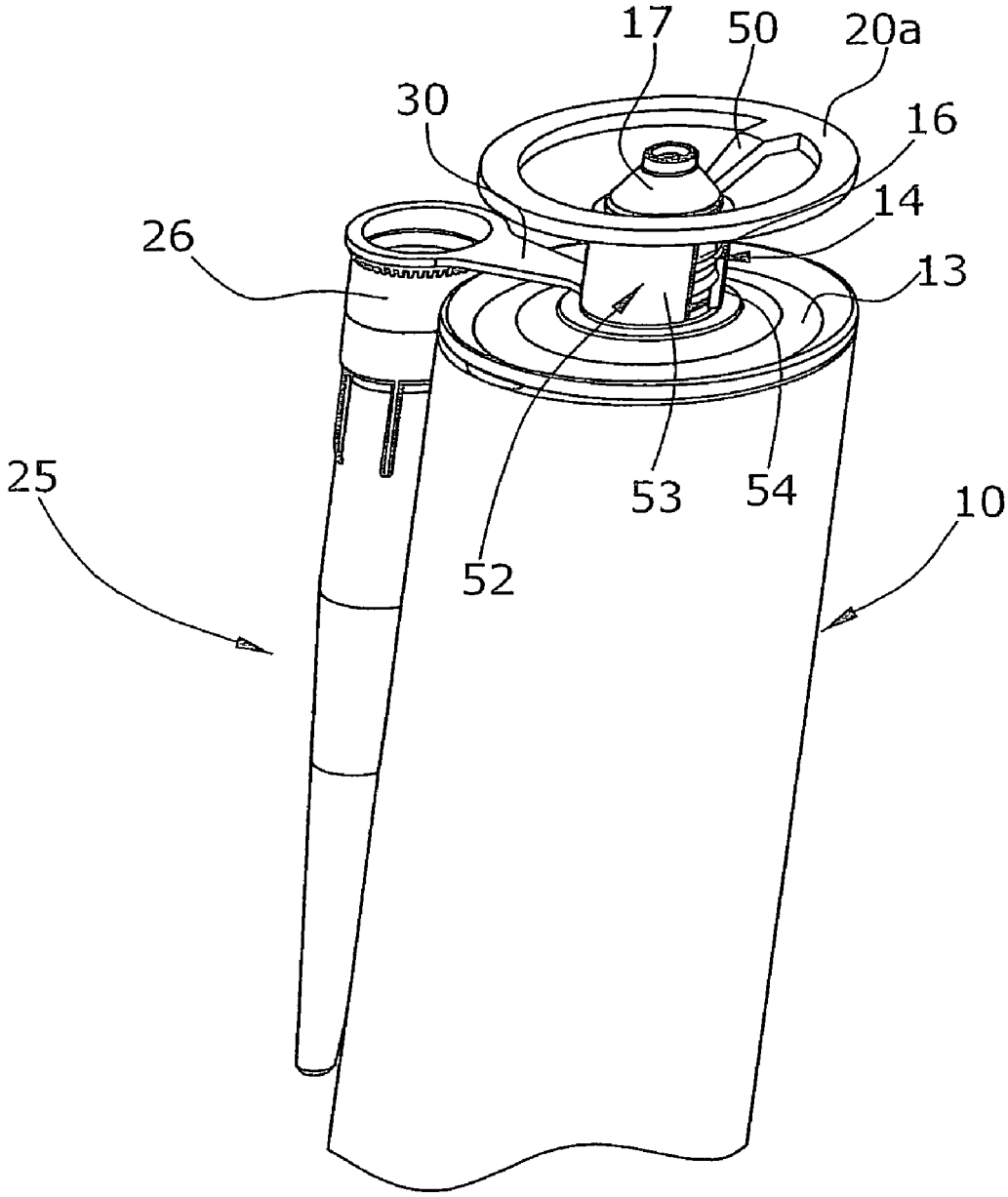
FIG. 7 illustrates another embodiment of the invention, wherein the application nozzle is connected with a guard means.

FIG. 7 illustrates an embodiment, in which the container body 10 is also closed at one end by an end wall 13 from which a connector 14 projects. The front end of the connector is closed by a tear-off part 17. A handle 20*a* is fastened to this tear-off part 17. A predetermined breaking point 16 is located below the tear-off part 17, where the tear-off part may be torn from the connector 14.

In the present instance, the handle 20*a* is a ring arranged coaxial with the container body 10 and being spaced axially from the end wall 13. This ring is connected with the tear-off part 17 through a web 50 or a spoke.

As shown in FIG. 7, the application nozzle 25 has its inlet end provided with a radially projecting tab 30. The outer end of the tab 30 has a guard means 52 formed by two fork prongs 53, 54 that are resilient and enclose the connector 14 between them. The guard means 52 extends across the height of the connector and thus covers the predetermined breaking point 16 at least partly. The guard means 52 prevents damage to the predetermined breaking point and thereby guarantees that the content of the packaging container does not prematurely come into contact with air and thus does not harden. The guard means may also be fixedly secured to the tear-off part 17 and be formed as a cap enclosing the connector and sitting on the end wall 13 by its lower edge.

The container of FIG. 7 is opened such that the guard means 52 is first pulled off sideways from the connector 14 by pulling the application nozzle 25, while the handle 20*a* is still connected with the connector. The tear-off part 17 is torn off at the predetermined breaking point 16 after the guard means 52 has been removed. The guard means can be pulled off sideways from the connector, since the two fork prongs 53, 54 may open resiliently. The application nozzle may now be turned over so that its tip points upward and that it may be screwed onto the connector 14.

Figure 8:
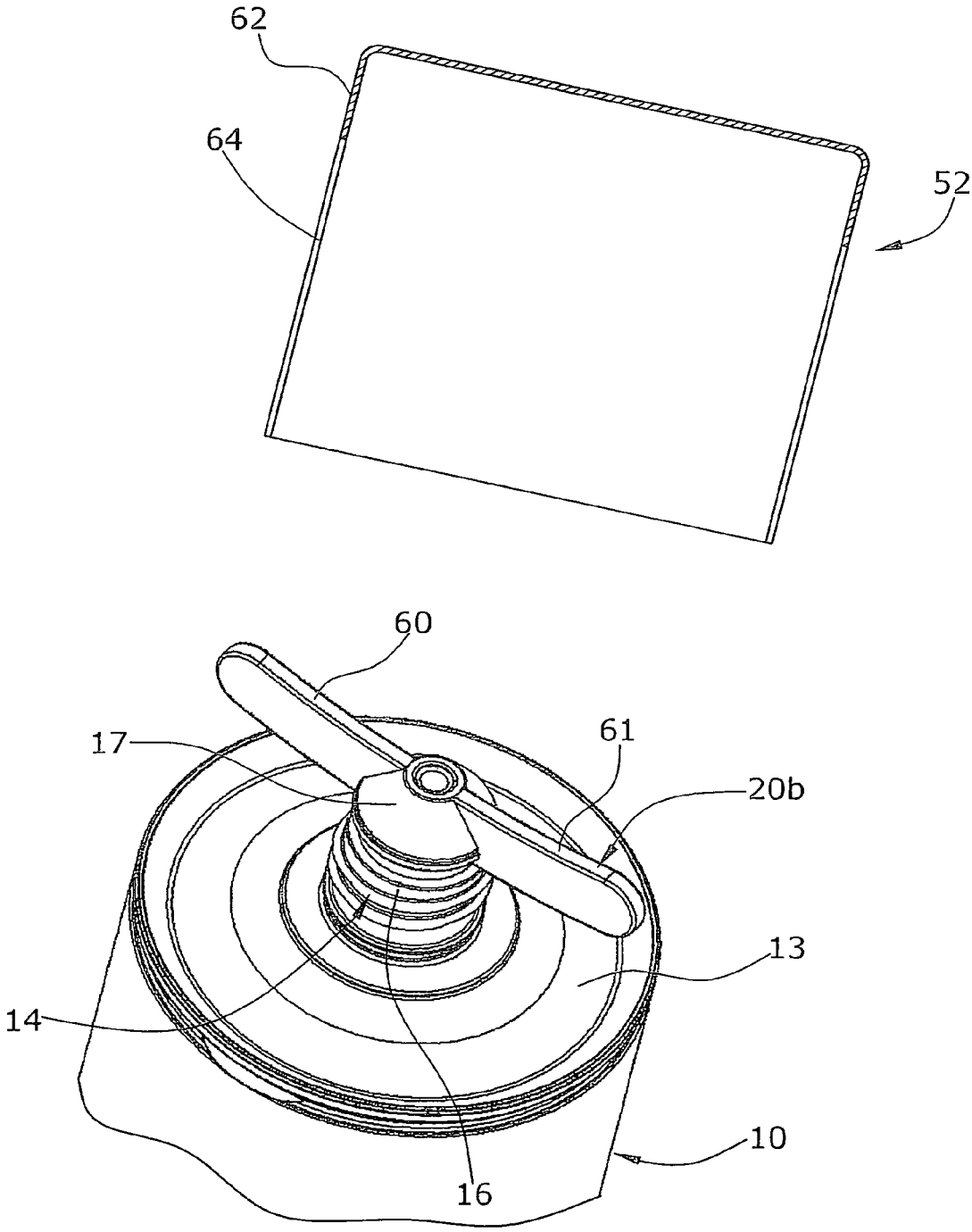
FIG. 8 shows another embodiment, wherein the handle has oppositely projecting handle arms and a guard means surrounding the connector is provided.

In the embodiment of FIG. 8, the handle 20*b* has two oppositely projecting handle arms 60, 1. A guard means 52 is formed by a cap 62 whose lower edge 63 may rest on the end wall 13 of the container body 10 and which protectively encloses the connector including the predetermined breaking point 16. The guard means 52 of FIG. 8 is cup-shaped, i.e. it has a circumferential sidewall and a closed top wall, whereas the bottom side is open. Two longitudinal slits 64 extend in the circumferential wall to receive the handle arms 60, 61. It is also conceivable to make the handle arms shorter so that they fit under the cap 62.

Although the invention has been described and illustrated with reference to specific embodiments thereof, it is not intended that the invention be limited to those illustrative embodiments. Those skilled in that art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A packaging container comprising a container body having its front end provided with an end wall comprising a connector, a predetermined breaking point provided at the connector, a tear-off part of the connector with a handle, adapted to be manually torn from the predetermined breaking point to open the container and an application nozzle having a tab and being attached to the container body via the tab, the tab comprising a window for the passage of the handle when the tab is attached to the container, and wherein the application nozzle is attached in a manner secured against rotation relative to the container body.

2. The packaging container of claim 1, wherein the application nozzle has a flexible tab attachable to the connector such that the application nozzle can be set onto and connected with the connector by bending the tab after the tear-off part has been removed.

3. The packaging container of claim 1, wherein the application nozzle comprises a tab with a ring seated in a circumferential groove of the connector.

4. The packaging container of claim 1, wherein the handle is annular in shape.

5. The packaging device of claim 1, wherein the handle is arranged within the peripheral contour of the container body.

6. The packaging device of claim 1, wherein the handle is of ergonomic design with a locally varying thickness.

7. The packaging device of claim 1, wherein a permeation-impairing layer is arranged at the predetermined breaking point.

8. The packaging device of claim 1, wherein the application nozzle has a dispensing opening with a closure removable without a tool.

9. The packaging device of claim 8, wherein the closure is formed to the application nozzle and comprises at least one gripping element for breaking off the closure.

10. The packaging device of claim 8, wherein the closure is formed by a cap set thereon.

11. The packaging device of claim 9, wherein a nozzle member open at both ends and including a joint spattle is provided which may optionally be set on the application nozzle instead of the cap.

12. The packaging device of claim 1, wherein the handle comprises two laterally projecting handle arms.

13. A method of assembling a packaging container of claim 1, wherein the cylindrical container body, which comprises a predetermined breaking point and a handle, and the application nozzle are oriented circumferentially with respect to each other and are then assembled.

14. The method of claim 13, wherein the assembly is effected with an axial or radial relative movement of the application nozzle with respect to the container body.

15. A method of assembling a packaging container of claim 1, wherein the application nozzle is attached to the connector or to the end wall below the handle through a relative radial or axial movement with respect to the container body.

16. A packaging container comprising a container body having its front end provided with an end wall comprising a connector, a predetermined breaking point provided at the connector, a tear-off part of the connector with a handle, adapted to be manually torn from the predetermined breaking point to open the container and an application nozzle having a tab and being attached to the container body via the tab, the tab comprising a window for the passage of the handle when the tab is attached to the container, and the handle forms an anti-rotation means for the tab.

17. A packaging container comprising a container body having its front end provided with an end wall comprising a connector, a predetermined breaking point provided at the connector, a tear-off part of the connector with a handle, adapted to be manually torn from the predetermined breaking point to open the container and an application nozzle having a tab and being attached to the container body via the tab, the tab comprising a window for the passage of the handle when the tab is attached to the container, and the handle does not extend beyond the tear-off part of the connector.

18. A packaging container comprising a container body having its front end provided with an end wall comprising a connector, a predetermined breaking point provided at the connector, a tear-off part of the connector with a handle, adapted to be manually torn from the predetermined breaking point to open the container and an application nozzle having a tab and being attached to the container body via the tab, the tab comprising a window for the passage of the handle when the tab is attached to the container, and the handle extends in a radial plane of the container body.

19. The packaging device of claim 18, wherein the application nozzle extends in the same radial plane as the handle.

20. A packaging container comprising a container body having its front end provided with an end wall comprising a connector, a predetermined breaking point provided at the connector, a tear-off part of the connector with a handle, adapted to be manually torn from the predetermined breaking point to open the container and an application nozzle having a tab and being attached to the container body via the tab, the tab comprising a window for the passage of the handle when the tab is attached to the container, and a guard means is provided that protects the predetermined breaking point of the connector against external influences.

21. The packaging device of claim 20, wherein the predetermined breaking point may be broken only after removal of the guard means.

22. The packaging device of claim 20, wherein the guard means is connected with the application nozzle.

23. The packaging device of claim 20, wherein the guard means is fork-shaped and comprises two resilient fork prongs.

24. The packaging device of claim 20, wherein the guard means is formed as a cup-shaped cap set over the connector.

* * * * *